United States Patent [19]

Auvil et al.

[11] 4,008,042

[45] Feb. 15, 1977

[54] COAL HEATING TEMPERATURE CONTROL

[75] Inventors: Harvey S. Auvil, Ashland; Rufus F. Davis, Jr., Kenwood, both of Ky.

[73] Assignee: Coaltek Associates, Morristown, N.J.

[22] Filed: Nov. 26, 1975

[21] Appl. No.: 635,479

Related U.S. Application Data

[63] Continuation-in-part of Ser. No. 498,152, Aug. 16, 1974, abandoned.

[52] U.S. Cl. ..... 432/26; 34/13; 432/4

[51] Int. Cl.[2] ..... F27B 3/24

[58] Field of Search ..... 432/1, 4, 26; 34/13, 34/26, 31; 241/17

[56] References Cited

UNITED STATES PATENTS

| | | | |
|---|---|---|---|
| 1,623,553 | 4/1927 | Randolph | 34/31 X |
| 2,691,830 | 10/1954 | Karnofsky | 34/13 |
| 2,900,737 | 8/1959 | Heller | 34/31 X |
| 3,786,573 | 1/1974 | Scheppe | 34/31 |

*Primary Examiner*—John J. Camby
*Attorney, Agent, or Firm*—Gerard P. Rooney; John P. Kirby, Jr.

[57] ABSTRACT

Method for maintaining preheating equipment used for heating coal at a temperature within a temperature range normally used for heating said coal in said equipment which comprises introducing into said equipment a heat-absorbing liquid at a rate sufficient to maintain said equipment within said temperature range. Typically, the heat-absorbing liquid is an aqueous solution, preferably water, and said temperature range for preheating said coal is from 250° to 700° F.

15 Claims, 4 Drawing Figures

COAL HEATING TEMPERATURE CONTROL

This application is a continuation-in-part application of U.S. Ser. No. 498,152 filed Aug. 16, 1974, now abandoned.

BACKGROUND OF THE INVENTION

This invention relates to industrial processes which call for the heating of coal, or the heating and drying of coal, to temperatures above 100° C. or 212° F. More particularly, this invention relates to a method for maintaining heating equipment for coal in standby operating condition, at a desired operating temperature in the heating equipment.

As an example, this invention has been adapted for use in a system for the charging of preheated coal into a coke oven wherein granular coal is preheated and conveyed as particles to coke ovens for the converstion of the coal particles into coke. While the preheated coal may be conveyed to the coke ovens by means of a coal charging car or larry car, preferable it is conveyed through a pipeline ("Pipeline Charging System"). In this example, the heating equipment for the coal is known as a "coal preheater" or as "preheating equipment" and patents which relate generally to the preheating of coal and charging the preheated coal into coke ovens include U.S. Pat. Nos.: 3,512,723 to J. A. Geoffroy; and 3,523,065 and 3,457,141, both to L. D. Schmidt.

In a Pipeline Charging System, large quantities of heat are supplied to the preheating equipment for the purpose of heating the coal to a temperature within the range of from 250° to 700° F. so that the coal is dry and below the temperature at which the coal is in a plastic state, thereby producing preheated coal prior to conveying the preheated coal particles through the pipeline. It is desirable to provide a method for maintaining the temperature of the various parts of the preheating equipment within a desired temperature range at times when the supply of coal being fed to the preheating equipment is either beginning, as during start-up of the equipment, or is interrupted.

The supply of coal being fed to the preheating equipment during start-up is normally gradually fed into the preheater until the feed rate reaches the desired rate while the equipment is maintained within the desired preheating range. However, the feed may be interrupted for any one of a number of reasons during operation of a coke plant. For example, any plant breakdown that delays the removal of the coke from the coke ovens may require interruption of the coal being fed to the preheating equipment. A malfunction in the preheating equipment or pipeline charging equipment may require interruption of the coal being supplied to the heating equipment. The normal effects of changes in personnel between the various shifts in the 24 hour operation of a coke plant may require interruption of the coal supply.

It is desirable to avoid the necessity of stopping the supply of heat to the preheating equipment or of greatly reducing the supply of heat, which would cool the preheating equipment to a temperature below the normal range of operating temperatures of the heating equipment and probably cause the oxygen content in the atmosphere in the heating equipment to rise. Such cooling is undesirable because when operation is resumed, the preheating equipment will then have to be brought up to the desired temperature again and down to the desired oxygen content. Instead, it is desirable to have a method of maintaining the heating equipment at the desired temperature during start-up operations or interruptions of coal feed and maintaining the heat source in a standby operating condition which keeps it in its normal range of operation with reference to heat output and combustion characteristics during below-capacity feed rates or interruptions of coal feed.

An emergency system is already known and used for preventing the temperature of the preheating equipment from rising to a dangerously high level during such interruptions of the coal feed in order to avoid damage to the equipment and possible formation of explosive mixtures. This prior art emergency system includes the injection of water automatically into the preheating equipment to absorb the heat. However, this emergency system causes substantially complete shutdown of the preheating equipment and does not maintain the heat output from a heat source in the heating equipment at a heat output level during interruption of coal feed which is within its normal range of heat output when coal feed is being supplied. Thus, this emergency system does not provide any method by which the temperature in the preheating equipment may be controlled in order to maintain the preheating equipment in standby operating condition, that is, at the desired level of temperature, during interruption of the coal feed.

SUMMARY OF THE INVENTION

The invention is a method for maintaining heating equipment for coal at a temperature within the temperature range normally used for heating coal in said preheating equipment by introducing into the equipment a heat-absorbing liquid at a rate sufficient to maintain the equipment at a temperature within the desired temperature range for preheating coal for conveying it to a coke oven, preferably a temperature range of from 250° to 700° F. One such method includes: monitoring the temperature in the preheating equipment; providing a heat-absorbing liquid to the preheating equipment; causing said liquid to absorb substantially all of the heat, normally absorbed by the coal fed to the preheater, from a heat source to cause the heat source to operate at a normal range of operation as if coal were being fed to the coal preheater; maintaining the heat output from the heat source at a heat output level within its normal range of heat output as when coal feed is being supplied; and controlling the amount of the heat-absorbing liquid being provided to the preheater at a level which will absorb sufficient heat in the heating equipment to maintain the temperature in the heating equipment at the desired level.

The method further includes: adjusting the heat output from the heat source to a heat level which is in the lower portion of the normal range of heat output from the heat source. The method further includes: selecting a location in the heating equipment at which the heat-absorbing liquid is provided. The step of selecting such a location includes: selecting a point in the heating equipment between the source of heat and the equipment which the coal feed normally contacts.

The step of providing the heat-absorbing liquid includes: injecting a supply of a liquid, such as an aqueous solution, such as the wash liquors used to wash the coke oven gases, or water, into the heating equipment.

The step of injecting the liquid in the preheating equipment includes providing a pipeline through which the liquid is supplied to the heating equipment. The step of controlling the amount of heat-absorbing liquid includes: providing a standby control valve for controlling the supply of the liquid to the heating equipment. The step of controlling the amount of liquid may further include adjusting the flow of liquid to the heating equipment to a flow rate which is based upon the normal heat output of the heat source supplying heat to the heating equipment.

The step of monitoring the temperature includes: positioning a temperature sensing element in the heating equipment downstream of the location at which the heat-absorbing liquid is provided.

This invention provides a number of significant advantages which include the following: First, this invention provides a method for maintaining preheating equipment for heating coal at a temperature within said equipment without cooling the heating equipment below its normal operating temperature. Second, this invention provides a method for testing the heating equipment and associated equipment, at operating temperatures without supplying coal to the heating equipment. Third, this invention provides for additional safety in the operation of heating equipment and pipeline charging equipment by providing a method for cooling the heating equipment and pipeline charging equipment, in addition to presently available emergency methods. Fourth, this invention provides a method for adjusting the burner of heating equipment to desired combustion conditions without overheating part of the equipment when the burner heat output is within its normal range of operation. Fifth, this invention provides a method for improving safety conditions in coal heating equipment and reducing the possibility of explosions by establishing conditions under which any required amount of time may be used in adjusting the heat source, such as a burner, and in adjusting the oxygen content in the heating equipment to any desired percentage before coal is introduced in the heating equipment.

DESCRIPTION OF THE DRAWINGS

FIG. 3 shows typical apparatus used to provide a heat-absorbing liquid to the venturi throat of FIG. 1.

DETAILED DESCRIPTION

This invention relates to a method for maintaining heating equipment for coal in a standby condition at a desired level of temperature in the heating equipment. The heating equipment is intended to heat the coal, or heat and dry the coal, to temperatures above 100° C. or 212° F., preferably to temperatures from 250° to 700° F. The detailed description will be in reference to a Pipeline Charging System in which the heating equipment is hereinafter called preheating equipment and the coal is heated (hereinafter called preheated coal) and then conveyed by pipeline into coke ovens. However, the method of this invention may be used with other heating equipment for coal and other than Pipeline Charging System, such as by a coal charging or larry car or other means for conveying the preheated coal into coke ovens.

Figure 1:
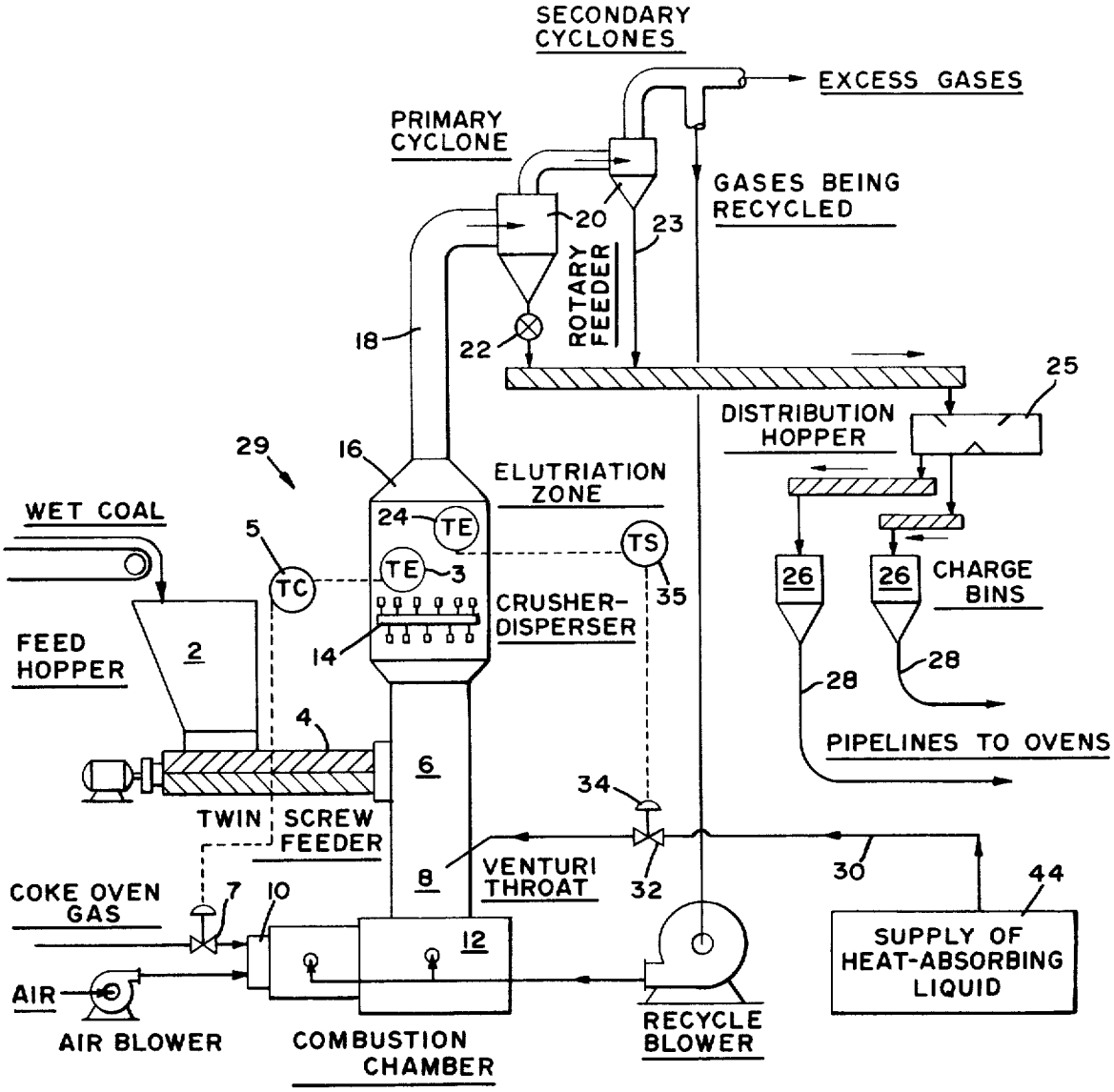
FIG. 1 is a schematic illustration of typical heating equipment as used with pipeline charging equipment in a coke plant, indicating an embodiment of this invention.
Figure 2:
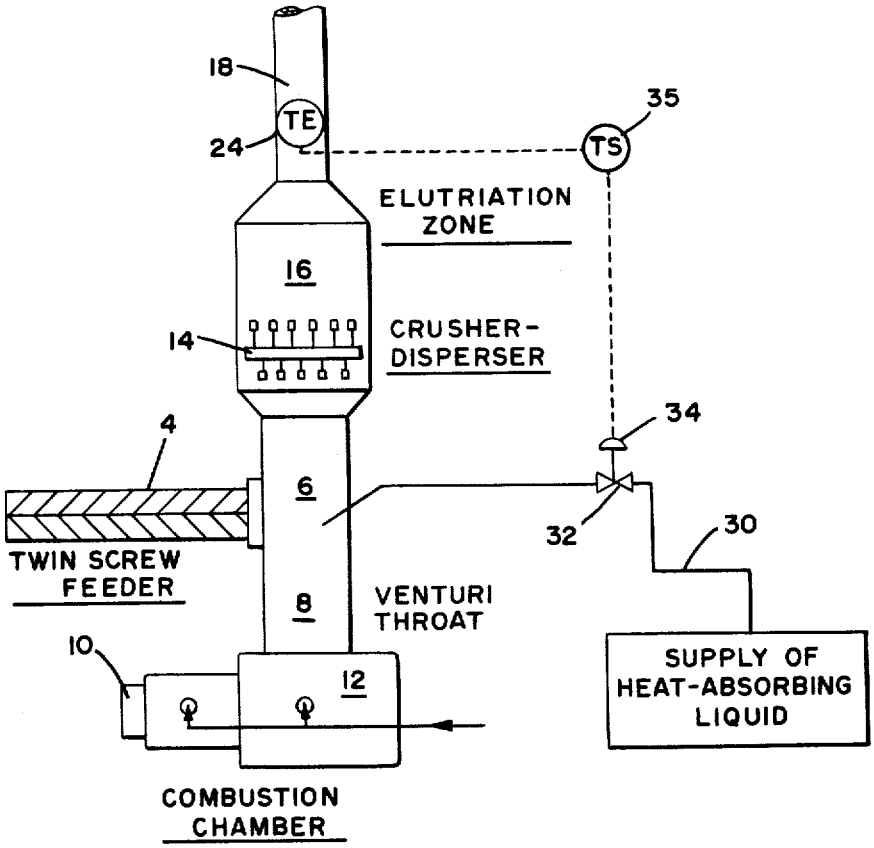
FIG. 2 is a partial schematic illustration of the same heating equipment shown in FIG. 1, but indicating another embodiment of this invention.

Referring to FIGS. 1 and 2, partially crushed, wet coal is supplied to a feed hopper 2, then to twin screw feeders 4, then to a flash drying chamber 6 above a venturi throat 8. A fuel (such as a coke oven gas) and air are supplied to a burner 10 of a combustion chamber 12 for combustion therein, producing hot flue gases. A temperature sensing unit 3 signals a temperature control unit 5 to adjust the flow of fuel through valve 7 to burner 10 to that required to maintain the temperature at the temperature sensing unit 3 at a preselected level, such as a temperature within the range of from 500° to 575° F. (260° C. to 300° C.). A group of sensing units (not shown) and controls (not shown) automatically adjust the air input to burner 10 proportionately to the fuel input to burner 10. Thus, the heat output of burner 10 is adjusted to produce the desired temperature in the preheating equipment, such as described in U.S. Pat. No. 3,512,723, as sensed by temperature sensing unit 3. The flue gases from the combustion chamber 12 travel up through the venturi throat 8 and contact the coal in the flash drying chamber 6. The hot flue gases heat the coal and evaporate a substantial part of the surface moisture on the coal, thereby producing partially dried, preheated coal. The partially dried coal moves up through a crusher-disperser 14, rotating in a dilute fluid bed in which the coal is further dried and heated, then through an elutriation zone 16 and then through a coal duct 18 which leads to a set of cyclones 20. The coal then moves through a rotary feeder 22 and/or feeder pipes 23 to a distribution hopper 25, then to charge bins 26, then to pipelines 28 which convey the coal, mixed with superheated steam, to coke ovens.

The method of this invention is applicable to the preheating equipment, referred to generally by the numeral 29. The preheating equipment 29 includes: the combustion chamber 12, burner 10, venturi throat 8, flash drying chamber 6, crusher-disperser 14, elutriation zone 16, coal duct 18, and cyclones 20, among other equipment. More particularly, the method of this invention relates to maintenance of the preheating equipment in standby operating condition, at a desired operating temperature during periods when the supply of coal through screw feeders 4 is below the capacity of the preheater to preheat it to the desired temperature.

This method includes: monitoring the temperature in the preheating equipment 29; providing heat-absorbing liquid to the preheating equipment 29 in amounts sufficient to absorb substantially all of the heat from the heat source, such as burner 10, which heat is normally absorbed by the coal in the preheater, causing the heat source to operate in its normal range of operation; maintaining the heat output from the heat source at a heat output level which is within the normal range of heat output when coal is being fed to the preheater; and controlling the amount of the heat-absorbing liquid to the preheater at a level which will absorb sufficient heat in the preheating equipment 29 to maintain the temperature in the preheating equipment at a desired level. In the embodiments of FIGS. 1 and 2, the heat source is a burner 10 which is part of combustion chamber 12.

The method further includes adjusting the heat output from the heat source to a heat output level which is in the lower portion of the normal range of heat output from the heat source when the coal is being supplied to the preheating equipment, prior to interruption of the coal feed to the preheating unit. In this embodiment, the heat output from the heat source is in the range of from 20 million BTU's per hour to 125 million BTU's per hour. As a first example, for a preheating unit rated at a nominal input of about 40 U.S. tons of coal per hour, the heat source may have a heat output capacity of about 20 million BTU's per hour. As a second example, for a preheating unit rated at a nominal input of about 100 U.S. tons of coal per hour, the heat source may have a heat output capacity of about 75 million BTU's per hour. As a third example, for a preheating unit rated at a nominal input of about 150 U.S. tons of coal per hour, the heat source may have a heat output capacity of about 125 million BTU's per hour. Preferably, in the first example for a 40 U.S. ton per hour unit, the heat-absorbing liquid is introduced into the preheater to require a heat output level from the heat source of approximately 5 million BTU's per hour during interruption of coal feed. Preferably, in the second example for a 100 U.S. ton per hour unit, the heat-absorbing liquid is introduced into the preheater to require a heat output level from the heat source of approximately 20 million BTU's per hour during interruption of coal feed. Preferably, in the third example for a 150 U.S. ton per hour unit, the heat-absorbing liquid is introduced into the preheater, to require a heat output level from the heat source of approximately 30 million BTU's per hour during interruption of the coal feed. Since the heat source is still fully in operation within its normal range of heat output during interruption of coal feed, operation of the preheating equipment can easily and conveniently be resumed, without delay in bringing the heat source back into operation.

The method further includes selecting a location in the preheating equipment 29 at which the heat-absorbing liquid is provided. The step of selecting such a location in the preheating equipment 29 includes selecting any convenient location in the preheating equipment 29 between the source of heat and the equipment which the coal feed normally contacts prior to interruption. For example, the heat-absorbing liquid may be provided at the venturi throat 8 in a first embodiment of this invention as illustrated in FIG. 1. In the alternative, the heat-absorbing liquid may be provided at the flash drying chamber 6 in a second embodiment of this invention as illustrated in FIG. 2. In the alternative, the heat-absorbing liquid may be provided at a location immediately under, that is, upstream of the crusher-disperser 14.

The step of providing the heat-absorbing liquid includes injecting a supply of the liquid, such as water, into the preheating equipment. The step of injecting a supply of water includes providing a pipeline 30 through which a flow of water is supplied to the preheating equipment 29. The step of monitoring the temperature includes positioning a temperature sensing element 24 in the preheating equipment 29 downstream of the location selected for providing the heat-absorbing liquid. In an embodiment, the temperature sensing element 24 may be positioned in the preheating equipment 29 downstream of the crusher-disperser 14, such as in the elutriation zone 16, as illustrated in FIG. 1. In the alternative, the temperature sensing element 24 may be positioned in the coal duct 18 of the preheating equipment 29 downstream from the elutriation zone 16 of the preheating equipment, as illustrated in FIG. 2. The elutriation zone 16 is located above the crusher-disperser 14. The function of the elutriation zone 16 is to separate larger particles in the coal stream.

Figure 3:
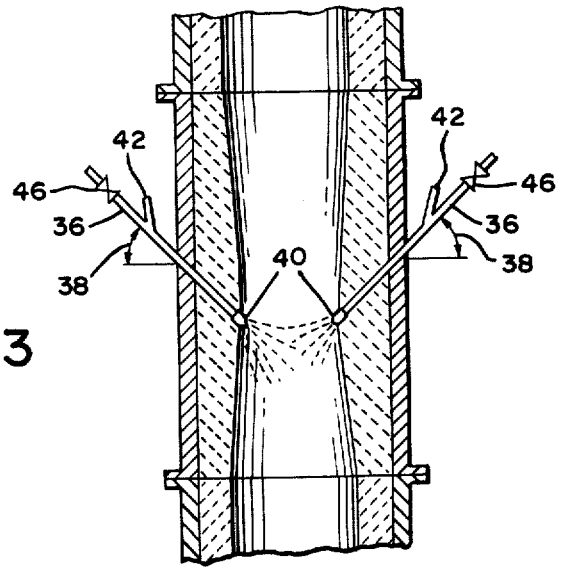
FIG. 3 is a cross-sectional view of a small portion of the heating equipment shown in FIG. 1.

In the embodiment illustrated in FIG. 1, where the location selected for providing the heat-absorbing liquid is the venturi throat 8, FIG. 3 illustrates a typical apparatus which may be used for injecting the heat-absorbing liquid, such as water, into the venturi throat 8. A plurality of conduits 36, such as pipes, are provided to conduct the heat-absorbing liquid into the venturi throat 8. In this example, four such conduits 36 are provided. In other embodiments, a greater or lesser number of conduits may be used. Preferably, each conduit 36 is arranged at an angle 38 with the horizontal of approximately 45°. Preferably, a nozzle 40 is provided at the interior end of each conduit 36 within the venturi throat 8 for the purpose of projecting the heat-absorbing liquid load across the high velocity flow of hot flue gases passing through the venturi throat 8. Spray nozzles 40 forming a cone pattern of approximately 45° are preferred. In the alternative, the heat-absorbing liquid may be projected through conduits 36 without the use of a nozzle, if a sufficient number of conduits are used such that the maximum injection rate is no more than five gallons per minute per conduit 36.

Apparatus similar to that illustrated in FIG. 3 may be used to inject the heat-absorbing liquid into the flash drying chamber 6, according to the embodiment illustrated in FIG. 2, or into other parts of preheating equipment. Water pipes of ½ inch diameter have been found to work well in supplying water to the preheating equipment. Referring to FIG. 3, each of the conduits 36 may preferably be provided with a purging means 42 for purging the conduits 36 of dust, such as by use of air, when the conduits 36 are not in use. Optionally, each of the conduits 36 may also be provided with a convenience valve 46.

The step of providing a supply of heat-absorbing liquid, such as water, may be accomplished in two ways: a simplified arrangement; or a more sophisticated arrangement. Referring to FIGS. 1 and 2, in the simplified arrangement, a simple, on-off, flow valve 32 is used. A predetermined flow of heat-absorbing liquid is provided from a supply of heat-absorbing liquid, which provides fixed, metered flow at a predetermined flow rate. A temperature switch (TS) 35 operates a flow control 34 to turn the supply of liquid on and off by means of flow valve 32 automatically according to the temperature in the preheating equipment 29 or manually at the discretion of the operator.

Figure 4:
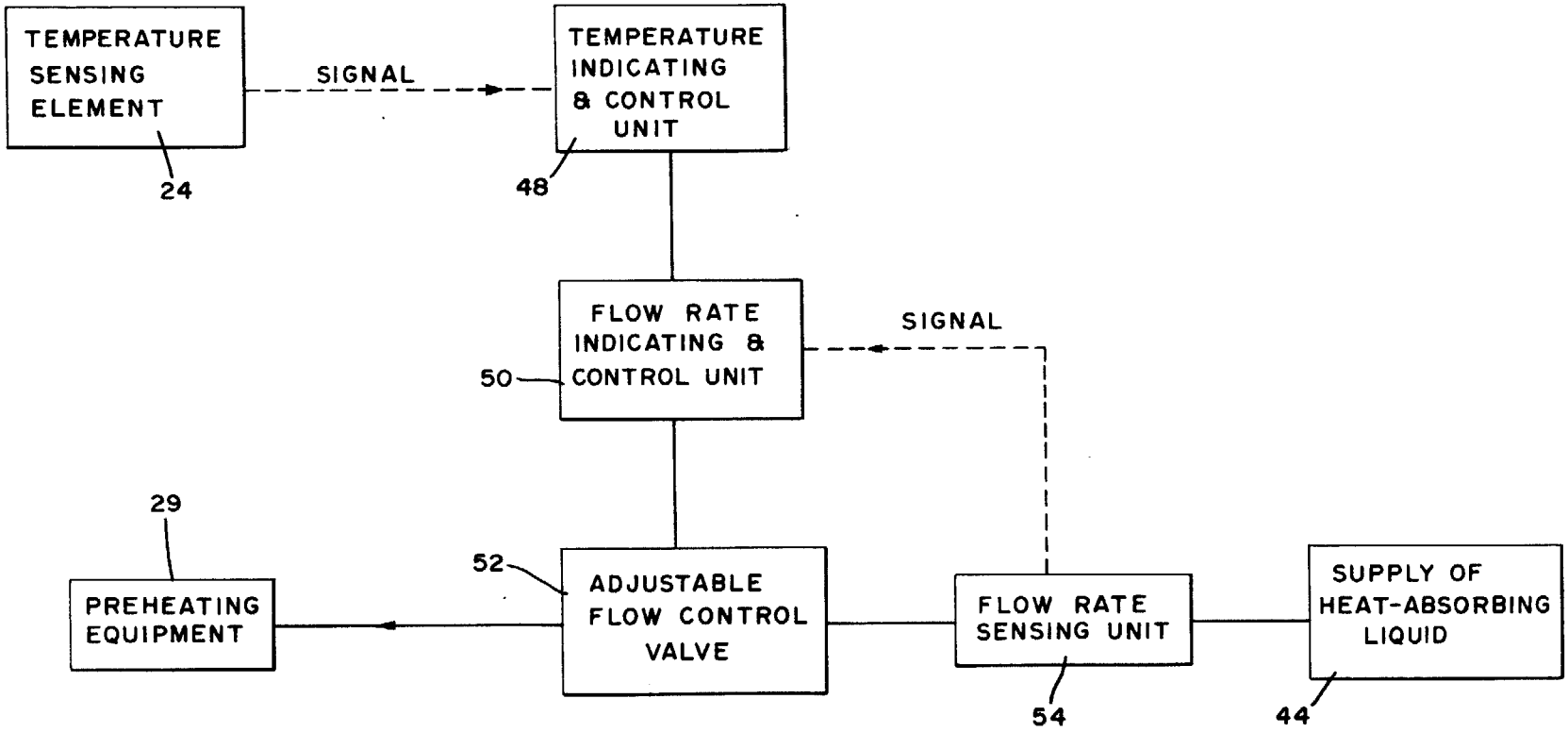
FIG. 4 is a block diagram of apparatus used in one embodiment of this invention for controlling the flow of heat-absorbing liquid.

Referring to FIG. 4, the more sophisticated arrangement permits an operator to adjust the flow of heat-absorbing liquid to the preheating equipment based upon the heat output of the heat source supplying heat to the preheating equipment 29. For example, the more sophisticated arrangement permits an operator to used a reduced flow of heat-absorbing liquid during start-up of the equipment. It also permits an operator to adjust the heat-absorbing liquid over the entire operating range of heat source capacity should this be desired for any reason, such as for checking uniformity of combustion at various operating rates. The more sophisticated method uses the temperature sensing element 24, a temperature indicating and control unit 48, a flow rate indicating and control unit 50, an adjustable flow control valve 52, and a flow rate sensing unit 54. The flow rate sensing unit 54 senses the flow of heat-absorbing liquid. The flow of heat-absorbing liquid is adjustable by means of the adjustable flow control valve 52. The flow rate sensing unit 54 transmits a signal to the flow rate indicating and control unit 50. As a result, the flow rate indicating and control unit 50 adjusts the flow control valve 52 to the desired flow rate of heat-absorbing liquid. The temperature sensing element 24 senses the temperature in the preheating equipment and the temperature condition is registered in the temperature indicating and control unit 48.

In both the simplified method and the more sophisticated method, the temperature sensing element may be a thermocouple means. In general, the flow rate should be in the range of 5 to 100 gallons per minute.

The desired flow rate may be established as follows. Assume that the capacity of the heat source is 60 million BTU/hour, for example. The desired flow rate is one which will use 20 to 30 million BTU's/hour, preferably 25 million BTU's/hour. In the example where the heat-absorbing liquid is water, the water is evaporated and the resultant steam is superheated to about 500° F. at about atmospheric pressure. (Coal drying and preheating equipment usually is operated at about atmospheric pressure.) For such conditions, each pound of water requires about 1250 BTU, and the water requirement is, therefore: (25,000,000/1250) = 20,000 lbs/hr (±20%) which is about 40 gallons per minute (±20%).

Most of the water injected into the preheating equipment 29 evaporates before it reaches the elutriation zone 16. By keeping the heat source, such as burner 10, within its normal range of operation, the atmosphere within the preheating equipment 29 will be maintained in a safe, non-explosive condition.

Controlling the atmosphere in the preheating equipment 29 also prevents detrimental oxidation of the coal being preheated by maintaining a low oxygen concentration. Keeping the oxygen content below 5%, by volume, eliminates the possibility of explosions from all possible sources. The oxygen content is normally held below 1% to minimize possible damage to the coking properties of the coals which are most sensitive to detrimental oxidation. As a safety measure, coal feed to the preheating equipment should not be started until the oxygen in the atmosphere of the preheating equipment is reduced to below 5%.

This invention provides a method for operating the burner within its normal range of heat output for the time required for adjustment, stabilization and verification of the oxygen content of the system.

What is claimed is:

1. A method for maintaining equipment used for heating coal at a temperature within a temperature range normally used for heating said coal in said equipment, which comprises introducing into said equipment a heat-absorbing liquid at a rate sufficient to absorb substantially all of the heat normally absorbed by said coal when fed to such equipment and to maintain said equipment at a temperature within said temperature range maintained for heating said coal in said equipment.

2. The method of claim 1 wherein the coal is heated in said equipment to a temperature within the range of 250° to 700° F.

3. The method of claim 1 wherein the introduction of the heat-absorbing liquid is adjusted during the introduction of coal into said heating equipment to maintain the temperature of said coal in said heating equipment at a temperature within the range of from 250° to 700° F.

4. The method of claim 1 wherein the flow rate of the heat-absorbing liquid is within the range of 5 to 100 gallons per minute.

5. The method of claim 1 wherein the oxygen content within the heating equipment is below 5%, by volume.

6. The method of claim 1 wherein the heat-absorbing liquid is an aqueous solution.

7. The method of claim 1 wherein the heat-absorbing liquid is water.

8. A method for maintaining heating equipment for coal in standby condition, at a desired level of temperature in the heating equipment provided with a heat source, during interruption of the coal feed to said equipment which comprises the steps of injecting a heat-absorbing liquid into the heating equipment in amounts sufficient to absorb substantially all of the heat from the heat source of the heating equipment normally absorbed by the coal fed to said equipment prior to interruption of the coal feed and to permit the heat source to operate in its normal range of heat output during injection of the heat-absorbing liquid into said equipment; and maintaining the heat output from the heat source at a heat output level during interruption of coal feed which is within its normal range of heat output as when the coal is being fed to said equipment.

9. The method according to claim 8 wherein the heat output from the heat source is adjusted to a heat output level during interruption of coal feed which is in the lower portion of the normal range of heat output from the heat source when the coal feed is being supplied.

10. The method according to claim 8 wherein the heat-absorbing liquid is introduced into the heating equipment between the source of heat and the equipment which the coal feed normally contacts prior to interruption.

11. The method according to claim 10 wherein said heating equipment includes a venturi throat and the heat-absorbing liquid is injected into said equipment in said venturi throat.

12. The method according to claim 10 wherein said heating equipment includes a flash drying chamber and the heat-absorbing liquid is injected into said equipment in said flash drying chamber.

13. The method according to claim 10 wherein said heating equipment includes a crusher-disperser and the heat-absorbing liquid is injected into said equipment at a location immediately upstream of crusher-disperser.

14. The method according to claim 8 wherein the heat-absorbing liquid is an aqueous solution.

15. The method according to claim 8 wherein the heat-absorbing liquid is water.

* * * * *